US008052501B1

(12) United States Patent
Friend

(10) Patent No.: US 8,052,501 B1
(45) Date of Patent: Nov. 8, 2011

(54) WATER TOY DEVICE

(76) Inventor: John H Friend, Galt, CA (US)

( * ) Notice: Subject to any disclaimer, the term of this patent is extended or adjusted under 35 U.S.C. 154(b) by 428 days.

(21) Appl. No.: 11/707,045

(22) Filed: Feb. 16, 2007

(51) Int. Cl.
*A63H 23/00* (2006.01)

(52) U.S. Cl. ..... 446/153; 446/61; 446/308; 446/486

(58) Field of Classification Search ..... 446/153, 446/61, 308, 486
See application file for complete search history.

(56) References Cited

U.S. PATENT DOCUMENTS 2,667,352 A * 1/1954 Sepersky ..... 473/613
3,384,373 A * 5/1968 Siegler ..... 473/578
3,612,528 A * 10/1971 Glass et al. ..... 446/308
4,507,096 A * 3/1985 Greenfield, Jr. ..... 446/61
4,512,690 A * 4/1985 Johnson ..... 446/61
4,904,219 A * 2/1990 Cox ..... 473/613
5,057,050 A * 10/1991 Hill ..... 446/61
5,240,448 A * 8/1993 Ishikawa ..... 446/64
5,364,299 A * 11/1994 Hill et al. ..... 446/61
5,733,164 A * 3/1998 Albrecht ..... 446/63
6,328,622 B1 * 12/2001 Geery ..... 446/153
7,037,164 B2 * 5/2006 Silverglate ..... 446/63
7,052,357 B2 * 5/2006 Silverglate ..... 446/153

* cited by examiner

*Primary Examiner* — Gene Kim
*Assistant Examiner* — Urszula M Cegielnik
(74) *Attorney, Agent, or Firm* — Theodore J. Bielen, Jr.

(57) ABSTRACT

A water toy device utilizing elongated body having first and second surfaces and first and second ends. A pair of wings extend from the elongated body and are bendable to determine the path of travel of the device in a body of water. An elongated fin projects from the first surface from the elongated body to stabilize the movement of the device.

8 Claims, 3 Drawing Sheets

WATER TOY DEVICE

BACKGROUND OF THE INVENTION

The present invention relates to a novel and useful water toy device.

In the past, devices and toys have been used in conjunction with bodies of water in order to increase the enjoyments of the occupants of the body of water by the playing of games and the like using such devices. For example, floatable balls, discs and such have been employed to play variations of well known games such as baseball, football, basketball, and others. In addition, certain toys have been devised which are capable of submerging within the body of water and rising again to the top, such as toys in the shape of submarines and diving bells.

A water toy device which is durable and is capable of moving through the body of water and rising again to the top of the body of water in a pre-determined path or trajectory would be a notable advance in the field of toys and games.

BRIEF SUMMARY OF THE INVENTION

In the accordance with the present invention a novel and useful water toy device is here in provided.

A device of the present invention includes an elongated body having a first surface, opposite second surface, a first end, and a second end. The elongated body is generally flattened and is some-what hydrodynamic to allow its passage through the body of water. In this regard, the elongated body is composed of floatable material such as a lighter-than-water polymeric material, such as high density polyethylene, PVC, and the like. In general, any material having a specific gravity of less than 1 would suffice in the construction of the elongated body of the present invention.

A pair of wings are fashioned to extend from the elongated body. Each of the pair of wings is bendable from either the first or second surface of the elongated body in order to pre-determine the direction of travel of the toy in the body of water.

In addition, an optional elongated fin projects from the first surface from the elongated body in order to provide stability. The fin is not necessary in all embodiments of the present invention. Likewise, a second pair of wings are constructed to extend from the elongated body for the same purpose as that recited for the fin. In addition, the first end of the elongated body would include a narrowed end portion. Needless to say, the elongated body the first and second pair of wings, and the fin may all be constructed of similar materials to allow the device of the present invention, as a whole, to be floatable in a body of water.

A recess is also formed along the fin which extends from the first surface of the elongated body. In this manner, the hand or foot of the user may be used to press downwardly on the water toy device to submerge the same against the bottom of a container of a body of water such as the bottom of a pool. At this point, the device may be launched below the surface with the application of a forward force and the release of a downward force by the hand or foot of the user.

It may be apparent that a novel and useful water toy device has been here in above described.

It is therefore an object of the present invention to provide a water toy device which follows a pre-determined path beneath the body of water.

Another object of the present invention is to provide a water toy device in which surface characteristics of the same may be altered in order to insure that the water toy follows a pre-determined path which is not a straight line.

Another object of the present invention is to provide a water toy device which may be launched below the surface of the body of water and follows a forward and rising path to the upper surface of the water upon the application of a force by the user.

A further object of the present invention is to provide a water toy device which is durable and relatively simple to manufacture.

Yet another object of the present invention is to provide a water toy device which follows a trajectory and travels at a speed commensurate with the force supplied to the same by the user.

Another object of the present invention is to provide a water toy device which travels at a speed dependent on the density of the device itself.

Another object of the present invention is to provide a water toy device which may be launched beneath the body of water without a boosting force by the hand or foot of the user and which will travel to the surface of the body of water following a generally predictable path or trajectory.

The invention possesses other objects and advantages especially as concerns particular characteristics and features there of which will be apparent as the specification continues.

For a better understanding of the invention reference is made to the following detailed description of the preferred embodiments there-of which is to be taken conjunction with the prior described drawings.

DETAILED DESCRIPTION OF THE PREFERRED EMBODIMENTS OF THE INVENTION

Various aspects of the present invention will evolve in the following detailed description of the preferred embodiments there of which should be read in conjunction with the prior delineated drawings.

Figure 2:
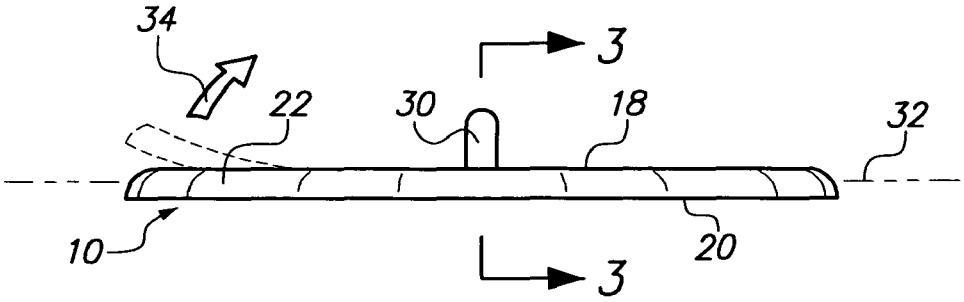
FIG. 2 is a front end view of the device of the present invention with a bent wing being illustrated in phantom.

An embodiment of the invention as a whole is depicted in the drawings by reference character 10 the order toy device 10. Device 10 includes as one of its elements elongated body 12. Elongated body 12 may be flattened and extend between a first end 14 and a second end 16. In addition, the elongated body includes a first side or surface 18 and a second opposite side or surface 20, FIG. 2. Surface 20 is shown as being flat, however surface 20 may possess a concave configuration resulting in a faster rise of device 10 from beneath the surface of body of water 38.

Figure 1:
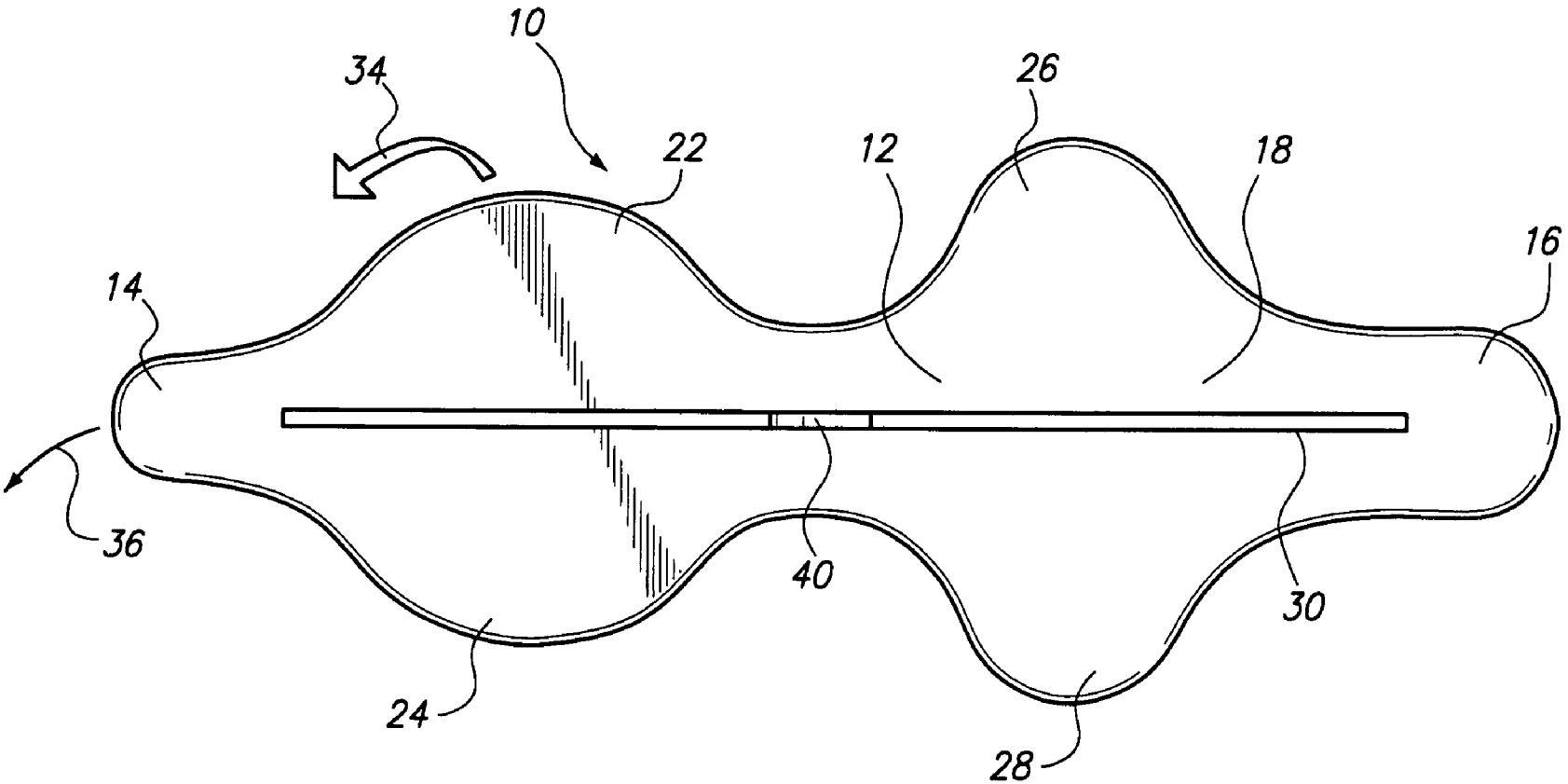
FIG. 1 is a top plan view of an embodiment of the invention of the present invention.

Again referring to FIG. 1, it may be seen that wings 22 and 24 extend from elongated body 12 nearest to first end 14 of the elongated body 12. Likewise, elongated fin 30 projects from first surface 18 of elongated body 12. Wings 26 and 28 extend from elongated body 12 nearest to second end 16 thereof.

Referring again to FIG. 2, it may be seen that water toy device 10 generally includes a flattened profile along axis 32. Wings 22 or 24 may be bent upwardly or downwardly to affect the trajectory or path of movement of water toy device 10. For example, wing 22 is depicted, in phantom, as being moved upwardly according to directional arrow 34. It is found that such alteration of the shape of water toy device 10 causes device 10 to travel a curving path to the left, according to directional arrow 36, FIG. 1. Optional fin 30 helps in providing stability to device 10 in the case where water toy device 10 is constructed of polymeric material, such bending may take place under the application of heat. It should also be noted that water toy device 10 and all of its components would permit water device 10 to float. This result is achieved by forming the components of water toy device 10 of a material or materials which would result in a specific gravity of less than 1. For example, polymeric materials, composite materials, and the like may be employed in this regard. Thus, wings 22 and 24 are employed to steer water toy device 10 while wings 26 and 28, as well as fin 30, stabilize the movement along a path of water toy device in a body of water.

Figure 3:
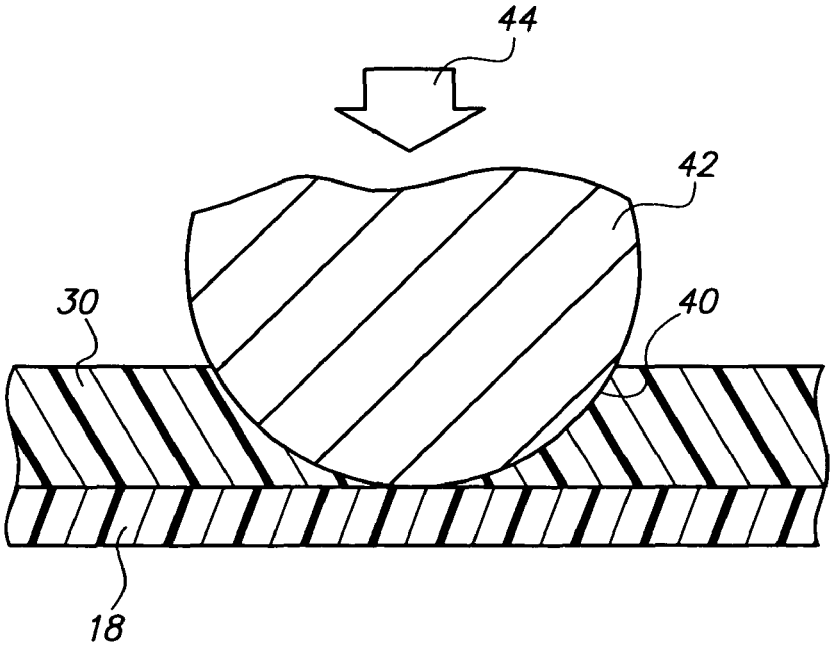
FIG. 3 is a sectional view of the embodiment of the invention depicted in FIG. 1 near its central portion with a directional arrow indicating a force of a hand or foot on the device prior to launch.
Figure 4:
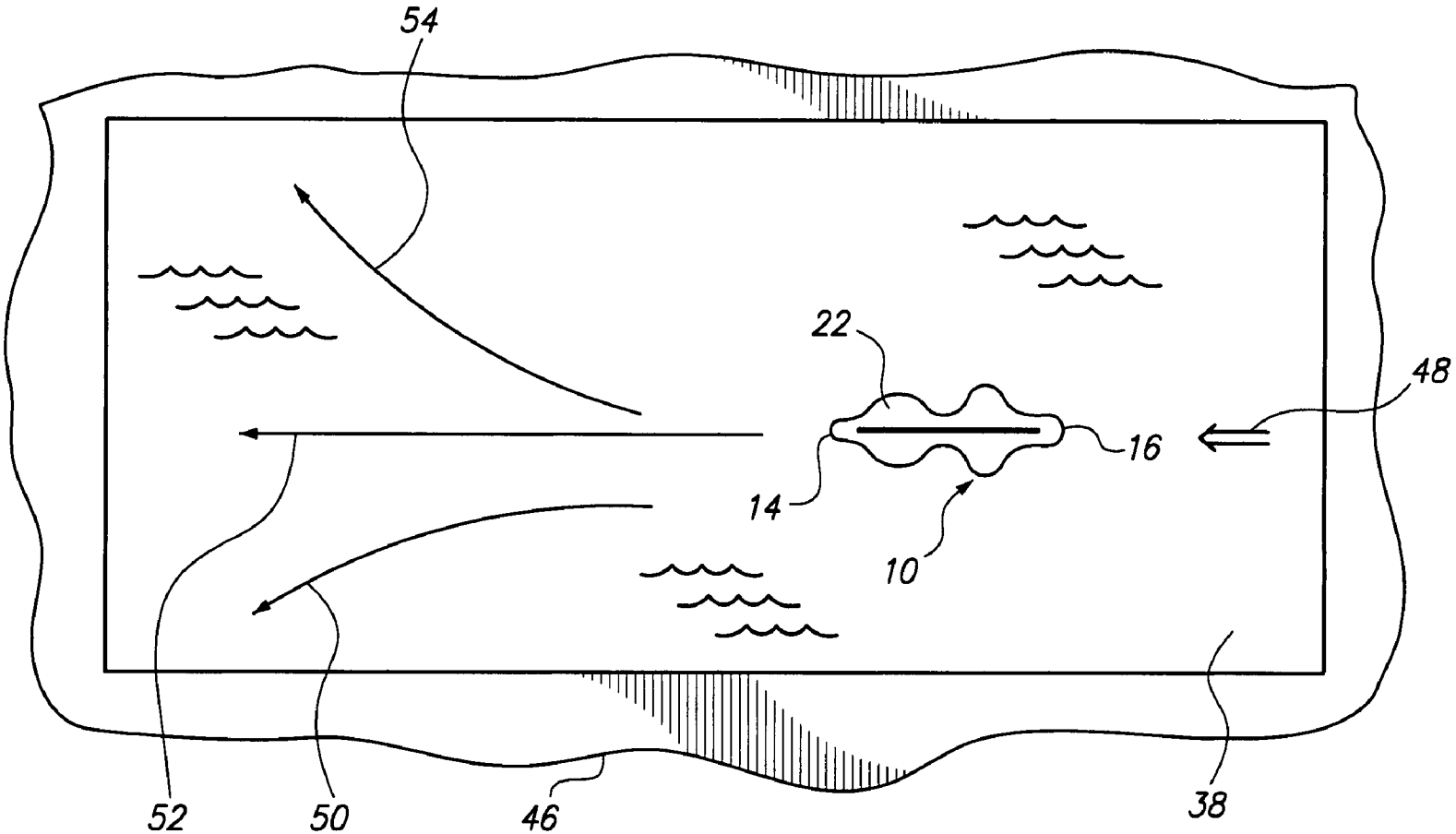
FIG. 4 is a top plan view of a pool showing the device of the present invention moving therewithin along typically paths.

In operation, the user presses down on water toy device 10 to push it below the surface of body of water 38, FIG. 4. Looking at FIG. 3, it may be observed that a recess 40 is formed in fin 30 to allow a appendage of the user such as a foot or hand 42 to exert a force on device 10 according to directional arrow 44. Referring now to FIG. 3, the body of water 38, is contained in a swimming pool 46 and water toy device 10 has been positioned below the surface of water body 38 A forward force has been applied by the user's hand or foot, according to directional arrow 48 Depending on the positioning of wings 22 or 24, water toy device 10 will follow typical paths 50, 52, on 54. It should be realized that water toy device 10 will follow a generally predictable trajectory without such application of a force. The bending of wing 22 on FIGS. 1 and 2 would result in a path or a trajectory closest to path 50. It should also be noted that although water toy device 10 begins its movements at the bottom of pool 46, it will slowly rise to the surface of body water 38 during its movement along any of the paths, such as paths 50, 52, or 54. A severe bending of any of the wings 22 or 24 may even result in water toy device returning to the launching individual in pool 46. It should also be realized that the overall appearance of device 10 may be formed to resemble water loving animals, such as fish, alligators, turtles, sharks, and the like, Also, human characteristics may be placed on device 10. For example, wings 22 and 24, as well as fin 30 and wings 26 and 28 may resemble particular appendages of animals and humans.

While in the forgoing embodiments of the inventions have set forth in considerable detail for the purposes of making a complete disclosure of the invention it may be apparent to those of skill in the art that numerous changes maybe made without departing from the spirit and the principals of the invention.

What is claimed is:

1. A water toy device floatable in water, comprising:

a. an elongated body having a first surface, an opposite second surface, and a continuous edge portion therebetween, said elongated body further possessing a first end and a second end;

b. a pair of wings extending from said elongated body, apart from first and second ends, each of said pair of wings possessing an edge forming a portion of said edge portion of said elongated body, each of said pair of wings being bendable, selectively, relative to said first and second surfaces of said elongated body and apart from said first and second ends, to alter the shape of said device and to alter the path of travel of said elongated body through a body of water thereby; and, c. an elongated fin projecting from said first surface of said elongated body apart from said continuous edge portion of said elongated body; said elongated fin further includes a recess therealong.

2. The device of claim 1 in which said elongated body is formed of a polymeric material.

3. The device of claim 1 in which said elongated body, said pair of wings, and said fin are constructed of polymeric material.

4. The device of claim 3 in which said first end of said elongated body includes a narrowed end portion.

5. The device of claim 1 in which said elongated body is formed of a polymeric material.

6. The device of claim 1 in which said pair of wings comprises a first pair of wings, and which further comprises a second pair of wings extending from said elongated body, said first pair of wings positioned closer to said first end of said elongated body than said second end of said elongated body, said second pair of wings being positioned closer to said second end of said elongated body than said first end of said elongated body.

7. The device of claim 1 in said pair of wings and said fin are constructed of polymeric material.

8. The device of claim 7 in which said first end of said elongated body includes a narrowed end portion.

* * * * *